US005918492A

United States Patent [19]

Klebes

[11] Patent Number: 5,918,492

[45] Date of Patent: Jul. 6, 1999

[54] TRIGGER GUARD-ENGAGING GUN LOCK

[75] Inventor: John F. Klebes, Feeding Hills, Mass.

[73] Assignee: Smith & Wesson, Springfield, Mass.

[21] Appl. No.: 08/789,402

[22] Filed: Jan. 29, 1997

[51] Int. Cl.[6] ..... F16H 57/00

[52] U.S. Cl. ..... 70/203; 70/57; 42/70.07; 42/70.11

[58] Field of Search ..... 70/202, 203, 211, 70/212, 58, 57; 42/70.06, 70.07, 70.11

[56] References Cited

U.S. PATENT DOCUMENTS

| | | | |
|---|---|---|---|
| 1,362,124 | 12/1920 | McCarthy | 70/203 |
| 1,549,638 | 8/1925 | Wallace | 70/14 |
| 3,022,596 | 2/1962 | Cannon | 42/70.06 |
| 3,352,047 | 11/1967 | McDonnell | 42/70.07 |
| 3,422,560 | 1/1969 | Foote et al. | 70/58 |
| 3,624,945 | 12/1971 | Foote | 70/202 |
| 3,713,239 | 1/1973 | Sperling | 42/70.07 |
| 4,030,221 | 6/1977 | Doobenen et al. | 42/70.07 |
| 4,198,026 | 4/1980 | Cadolupo | 211/64 |
| 4,723,370 | 2/1988 | Sheehan | 42/70.07 |
| 5,048,212 | 9/1991 | Mossberg | 42/70.11 |
| 5,544,440 | 8/1996 | Stockman | 42/70.07 |
| 5,724,760 | 3/1998 | Langer | 42/70.11 |

FOREIGN PATENT DOCUMENTS

| | | | |
|---|---|---|---|
| 0000117 | 4/1899 | Austria | 42/70.07 |
| 968669 | 9/1964 | United Kingdom | 42/70.07 |

*Primary Examiner*—Darnell M. Boucher
*Attorney, Agent, or Firm*—McCormick, Paulding & Huber

[57] ABSTRACT

A trigger-engaging plug for a firearm having of the type that is a trigger guard defining lateral openings and a trigger. A rear portion of the trigger is spaced from and in opposed relation with a portion of the firearm frame. The plug includes a base portion having a size and shape corresponding generally to one of the lateral openings. The plug also has a trigger-blocking projection extending from and positioned generally at one end of the base portion. The trigger-blocking projection defines a lock shackle-receiving bore. A tang extends from and is positioned on the base portion and in opposed relation with the first or trigger-blocking projection. The trigger-blocking and tang define a recess of a size and shape corresponding to a trigger. When the plug is inserted in the trigger guard of a firearm, the trigger is received within the recess, the trigger-blocking projection is positioned behind the trigger to prevent the trigger from being actuated, and the bore is positioned to receive a lock shackle between the rear of the trigger and the firearm frame. Another embodiment of the invention is for single action and other firearms with less space between the trigger and frame behind the trigger.

1 Claim, 4 Drawing Sheets

TRIGGER GUARD-ENGAGING GUN LOCK

BACKGROUND OF THE INVENTION

The present invention relates generally to locks for firearms, and more particularly to locks which are inserted within and engage the trigger guards of firearms to prevent actuation of a trigger.

The safe storage of firearms is becoming a more important issue with each passing day. All too often, news reports contain stories concerning children and adults who are either injured or killed by a person who gained access to a firearm which was either unlocked, carelessly hidden, or believed by its owner to be safely locked. Firearm locks play an important role in firearm safety, specifically where a firearm is stored or otherwise will not be used for a period of time. There are numerous types of locks for handguns, rifles and other types of firearms, including locks which engage the trigger guard or which conceal the trigger of the handgun or other firearm. One exemplary lock is an insert-type lock, which is positioned within or around the trigger guard, and covers and prevents access to the trigger.

Insert-type locks described in U.S. Pat. Nos. 2,664,658 to Bjorklund; 2,742,726 to Feller; 3,222,809 to Bryan; 3,392,471 to Foote; 4,509,281 to Dreiling; 4,852,286 to Troncoso et al.; 5,050,328 to Insko; 4,719,713 to Hagle; 5,033,218 to Nelson; and 5,400,538 to Shannon show gun locks which include members positioned behind a trigger and between the trigger and trigger guard or frame. However, none of those devices includes a lock positioned behind the trigger, i.e., between the rear of the trigger and the frame. It is therefore possible to remove the insert from the trigger housing even if the lock is in place. Since a lock used with any of the above devices is positioned in front of the trigger, a child or other person who removes the plug from a "locked" firearm can actuate the trigger, potentially with catastrophic results.

A lock which may be positioned behind a trigger is shown in U.S. Pat. No. 5,367,811 to Sansom. The Sansom lock device is a specially constructed lock, and designed to appear to be key-operated. A locking loop 23 is passed within a trigger guard 12 of a fire arm 11. The locking loop 23 is locked into a housing 15 by a latch plate 18*a*. A false key 22 is also provided, but does not operate. Sansom does not require that the lock be positioned behind the trigger. Moreover, the Sansom device does not lock. Thus, any person is capable of quickly manually removing the "lock" and firing the weapon. Sansom also does not employ a conventional lock.

In some firearms, particularly single action and some smaller caliber handguns, the spacing between the trigger and the rear portion of the trigger guard/frame is too small to receive a lock shackle. One proposed device for these firearms is described in U.S. Pat. No. 2,590,516 to de von Breymann. Von Breymann shows a trigger safety for firearms, and includes a block 10, which is adapted to fit in a trigger guard 12 and defines a recess 16 for receiving the firearm trigger 18. A circular disk 28 is received for sliding movement in the block, and a handle 30 is provided for sliding the disk 28 to cover or uncover trigger 18 when the trigger is positioned within the recess 16. While the von Breymann device includes a cover 20 behind the trigger, there is no mechanism for locking the trigger safety once it is installed on the firearm. Thus, a user or another person could easily remove the trigger safety and fire the weapon.

It would be desirable to provide a locking device which overcomes the drawbacks and disadvantages of known devices.

SUMMARY OF INVENTION

According to one aspect of the present invention, a trigger-engaging plug is adapted for a firearm that has a trigger guard defining lateral openings and a trigger. In such a firearm, a rear portion of the trigger is spaced from, and in opposed relation with, a portion of the firearm frame. The trigger is moveable towards the firearm frame to actuate the trigger.

A base portion of the plug has a size and shape corresponding generally to one of the lateral openings. The plug includes a trigger-blocking projection, which extends from and is positioned generally at one end of the base portion. The trigger-blocking projection defines a lock shackle-receiving bore.

The plug further preferably includes a tang, which extends from and is positioned on the base portion, and in opposed relation with the trigger-blocking projection. The trigger-blocking projection and the tang define a recess corresponding to the size and shape of a trigger. When the plug is inserted in the trigger guard of a firearm, the trigger is received within the recess, the trigger-blocking projection is positioned behind the trigger to prevent the trigger from being actuated, and the bore is positioned to receive a lock shackle between the rear of the trigger and the firearm frame.

According to another aspect of the invention, a trigger-engaging insert is provided for a firearm of the type that has a trigger guard defining lateral openings and a trigger, as above, but the clearance between the rear portion of the trigger and the firearm frame is not great enough to receive a lock shackle.

The insert includes a central projecting portion having a face of a size and shape corresponding to one of the openings and defining a throughboro extending between the lateral openings of the trigger guard for receiving a lock shackle, and a trigger-blocking projection positioned at one end in the space between the trigger and the frame to prevent movement and actuation of the trigger. The insert defines a trigger-receiving recess between the trigger-blocking projection, and the central projecting portion.

A slide is coupled to the insert, and is movable between first and second positions. In one position, the slide substantially covers the through bore and permits access to the recess to enable the trigger to be installed in and removed from the recess. In the other position, the slide covers the recess, conceals the trigger and permits access to the through bore to enable the insert to be locked to the firearm. The trigger blocking projection is then positioned in the space between the trigger and the frame to prevent actuation of the trigger.

The present invention has a number of advantages over known devices. In the first embodiment, the present invention provides a trigger-engaging plug that blocks rearward movement and actuation of the trigger. In addition, the trigger-engaging plug requires the user to pass a lock shackle behind the trigger, and thus the trigger cannot be actuated even if the trigger-engaging plug is removed from the trigger guard while locked. The present invention thus enhances the safety with which a firearm is stored. In the second embodiment, the present invention not only provides an insert used in combination with a lock, but the lock cannot be locked unless the insert is properly installed on the firearm.

In either embodiment, the present invention provides a measure of safety that is inexpensive and simple to operate, and is readily adaptable for use with either handguns or long guns. Each embodiment is fabricated of a molded plastic material. Therefore, the present devices can be manufactured at a significantly lower cost than the specially constructed locks discussed above.

Both embodiments fit within a firearm trigger guard, rather than around the guard as do "clamshell" type locks which cover the trigger guard and trigger, to prevent the presence of gaps between the plug or insert and the trigger guard. Thus, the present invention provides a more secure locking than clamshell type devices, since there are no gaps around the trigger guard between which an implement can be inserted to actuate the trigger.

The present devices are each used with a separate lock. By employing a plug or insert separate from the lock, it is possible to use a lock of conventional construction, which further reduces the costs associated with locking a firearm, and further promotes the safe storage of firearms.

Additional advantages will become apparent to those skilled in the art in view of the following drawings and detailed description.

DETAILED DESCRIPTION OF THE PREFERRED EMBODIMENTS

Figure 1:
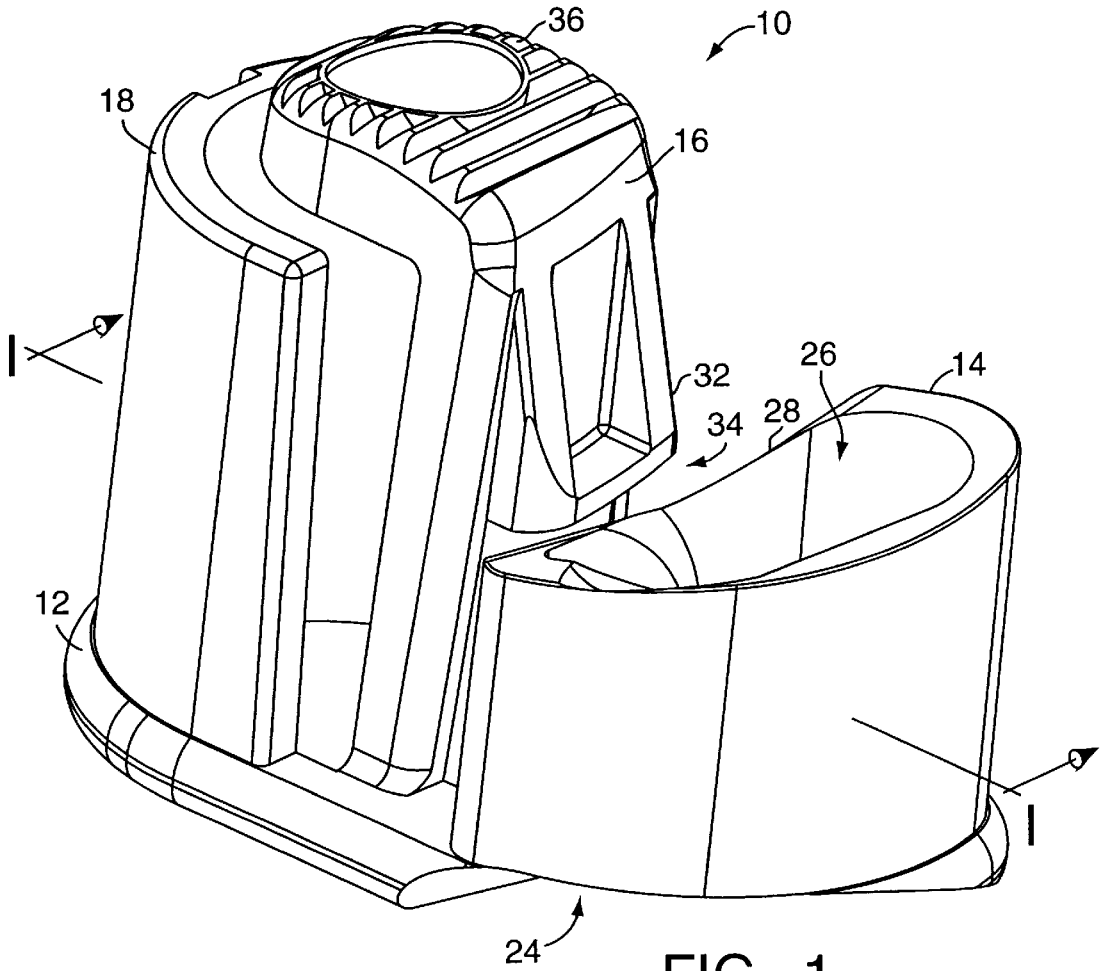
FIG. 1 is a perspective view of an insert-type trigger-engaging plug in accordance with the present invention.

Turning now to FIG. 1, trigger-engaging plug in accordance with the present invention is indicated generally by the reference numeral 10. The plug is designed to fit into the trigger guard 11 of most of the handguns manufactured by Smith & Wesson Corp., the assignee of the present invention, as shown for example in dashed lines in FIG. 4. Those skilled in the art will recognize that the specific dimensions of the plug illustrated in the drawings can be adjusted to fit handguns produced by other manufacturers, as well as many other types of firearms.

The plug 10 includes a base portion 12, a first or rearward trigger-blocking projection 14, a tang 16, and a second or frontward projection 18. The plug is monolithic and is preferably fabricated from an injection-molded polymer such as the material marketed under the name "ZYTEL®" by E.I. duPont de Nemours, of Wilmington, Del., although other materials may be employed with equal effect.

The base portion 12 is of a size and shape to generally correspond to the size and shape of an opening 20 defined between the trigger guard 11 (FIG. 4) and the adjacent portion of the frame 22 (FIG. 4) of the handgun. Preferably, the base portion is slightly larger than the opening 20, but the base portion need not be so large. An area 24 of the base portion adjacent to the first projection 14 is removed to facilitate inserting a plug shackle into the lock 10, as is described further below.

Figure 2:
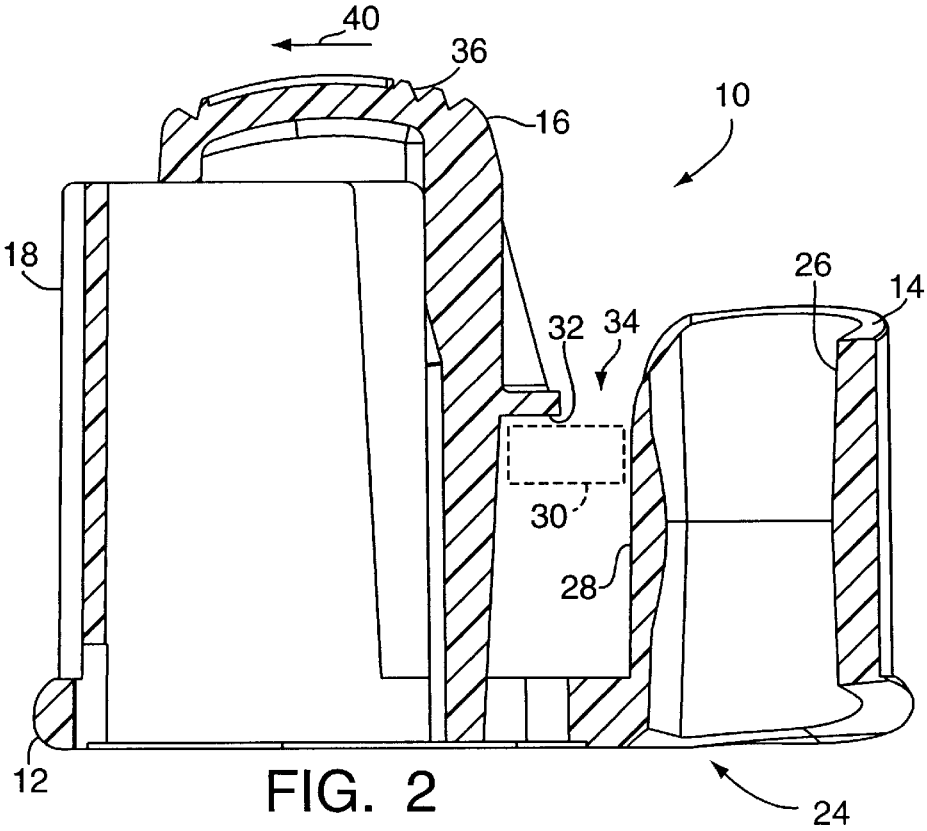
FIG. 2 is a sectional view of the trigger-engaging plug taken along the line I—I of FIG. 1.
Figure 3:
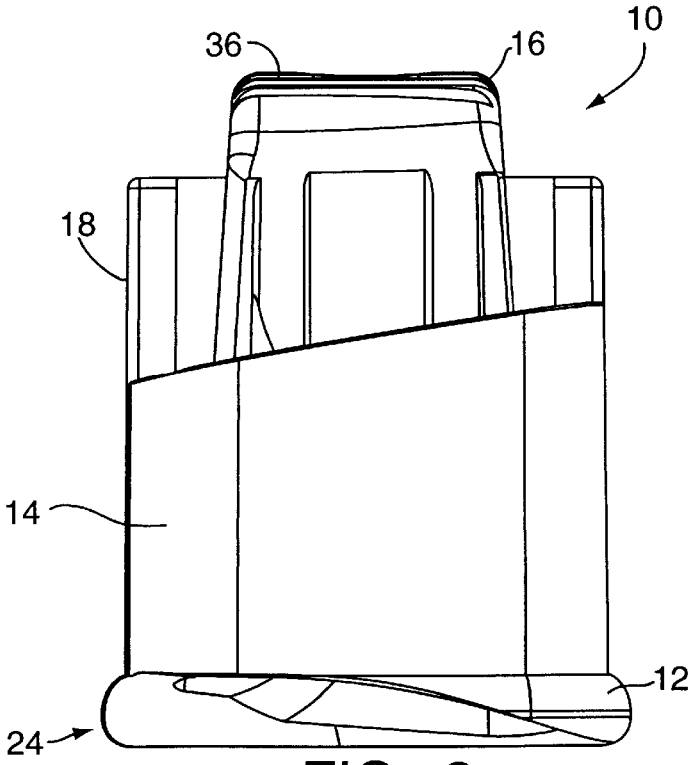
FIG. 3 is a side elevation view of the trigger-engaging plug of FIGS. 1 and 2.
Figure 4:
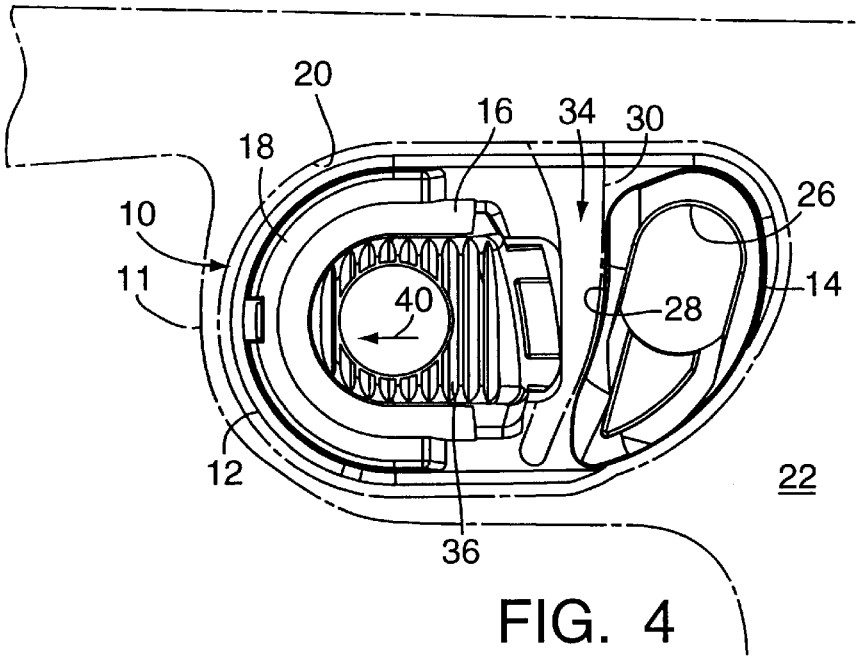
FIG. 4 is a top view of the trigger-engaging plug of FIGS. 1–3.

As shown in FIGS. 1–3, the first or trigger-blocking projection 14 is positioned at one end of the base portion 12, and extends upwardly (as illustrated in the drawings) from the base portion. The first projection 14 is angled at its top, and defines a throughbore 26 through which a shackle of a conventional lock is passed when a trigger-engaging plug 10 is placed in the trigger guard 11 to releasably lock the trigger-engaging plug onto the firearm, as is described further below. The first projection also defines a sidewall 28 which is shaped to correspond at least generally to the shape of a rear portion of a trigger 30 (FIG. 4). The first projection extends between the rear portion of the trigger 30 and an adjacent portion of the frame 22 in order to prevent actuation of the trigger and discharge of the firearm.

As shown best in FIGS. 1 and 2, the tang 16 is positioned near the middle of the base portion 12, and extends upwardly (as illustrated in the drawings) from the base portion, preferably extending upwardly further than does the first projection. The tang 16 includes a cantilevered flange with a shoulder 32. The tang 16 also defines a sidewall 46. The shoulder 32 extends from the tang 16 towards the trigger-engaging or first projection. The first projection and the tang cooperate to define a trigger-receiving recess 34. As the plug 10 is inserted into the trigger guard, the trigger is inserted over the shoulder, which snaps onto the trigger and retains the trigger in the trigger-retaining recess 34. The top of the tang 16 includes a textured surface 36, to enable the flange to be moved as indicated by the arrow 40 in FIG. 2. When the trigger-engaging plug is installed and a lock shackle is removed, the top surface is manually moved away from the first projection 14, to move the shoulder 32 away from the trigger 30 and enable the trigger-engaging plug 10 to be removed from the firearm.

The second projection 18 is positioned at the other end 44 of the base portion 12, and extends upwardly (as illustrated in the drawings) from the base portion, wherein the tang extends upwardly slightly beyond the second projection, so that the top surface 36 of the tang 16 is a cap and can be moved sufficiently to remove the trigger-engaging plug 10, as described above. The second projection and the tang cover a portion of the opening 20 formed by the trigger guard 11 and the firearm frame 22, and specifically to cover substantially all of that portion of the opening between the trigger 30 and the front of the trigger guard 11, to prevent a user from placing a lock in front of the trigger. Thus, a user is required to lock the firearm by passing a lock shackle through the bore 26 associated with the first or trigger-blocking projection 14 and behind the trigger 30. A lock positioned behind the trigger therefore prevents actuation of the trigger even if the trigger-engaging plug 10 is accidentally or intentionally removed from the trigger guard while the firearm is locked.

As noted above, in some firearms, particularly single action and some smaller caliber firearms, the space between the rear of the trigger and the adjacent portion of the firearm frame is not great enough to pass a lock shackle. Nevertheless, it is desirable to provide an insert-type lock for such firearms which is capable of receiving a lock shackle to positively prevent actuation of the trigger. A second embodiment of the present invention is indicated generally in FIG.

Figure 7:
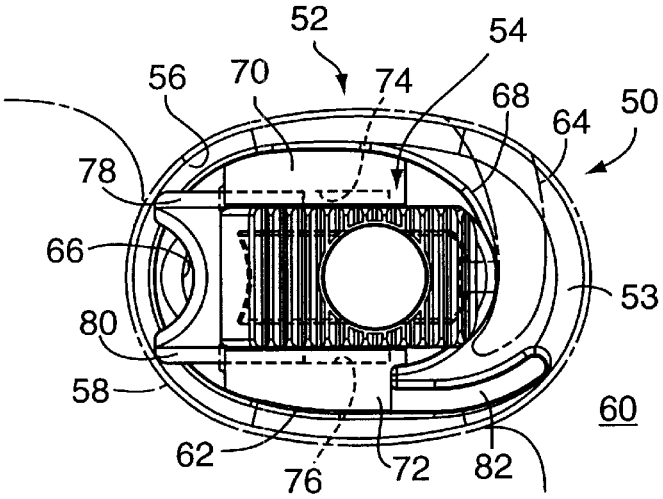
FIG. 7 is a top view of the lock of FIGS. 5 and 6, illustrating the slide in a first, retracted position for installing and removing the insert to a firearm.
Figure 8:
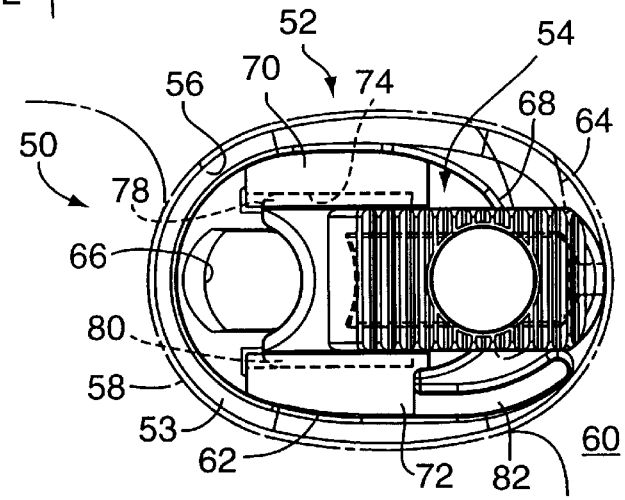
FIG. 8 is a view similar to FIG. 7, but illustrating the slide in a second, trigger covering position.
Figure 5:
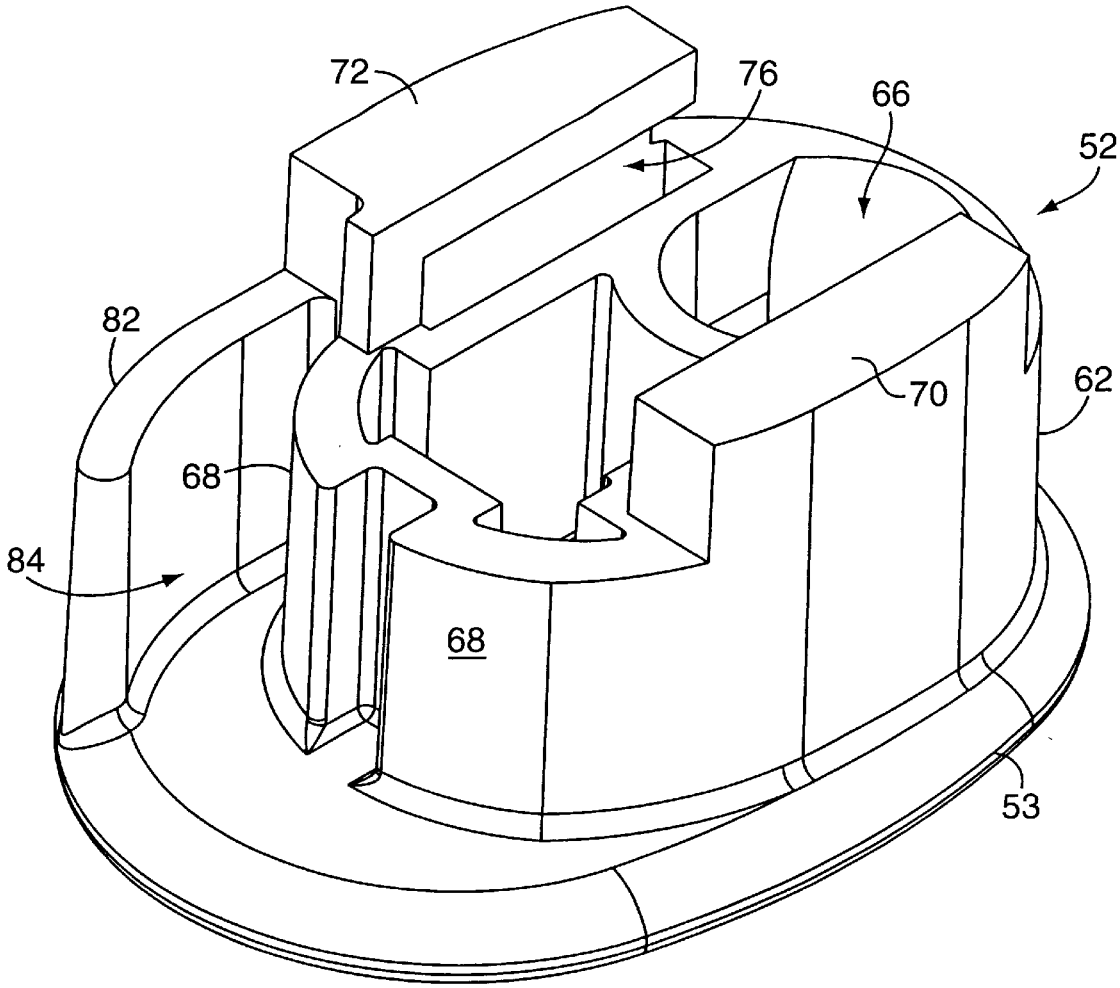
FIG. 5 is a perspective view of a second embodiment of the trigger-engaging insert in accordance with the present invention, with a slide portion of the embodiment removed, for use with smaller caliber and other firearms having less clearance between a trigger and the associated frame.
Figure 6:
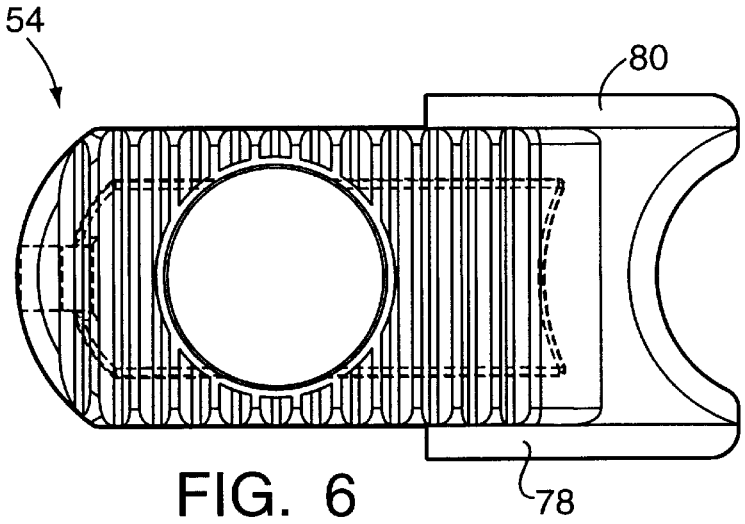
FIG. 6 is a top view of the slide portion of the second embodiment of FIG. 5.

8 by the reference numeral 52, and includes a base 53 (FIG. 5) and a slide 54 (FIG. 6). As shown in FIGS. 7 and 8, the slide is mounted on and movable relative to the base between first and second positions. The insert is preferably fabricated from an injection-molded polymer such as the material marketed under the name "ZYTEL"® by E.I. duPont de Nemours, of Wilmington, Del., although other materials may be employed with equal effect.

The base plate 53 is of a size and shape to generally correspond to the size and shape of an opening 56 defined between the trigger guard 58 (FIGS. 7 and 8) and the adjacent portion of the frame 60 (FIGS. 7 and 8) of the handgun. Preferably, the base portion is slightly larger than the opening 56, but the base portion need not be so large.

A central projecting portion 62 is positioned on the base plate 53, and extends upwardly (as illustrated in the drawings) from the base plate. As shown in FIGS. 7 and 8, the central projecting portion is positioned between the front of the trigger 64 and the trigger guard 58, when the insert is installed on the firearm. Returning to FIG. 5, the central projecting portion 62 defines a throughbore 66 through which a shackle of a conventional lock is passed when and insert 52 is placed in the trigger guard 58, to releasably lock the insert onto the firearm, as is described further below. The central projecting portion 62 also defines a sidewall 68 which is shaped to correspond at least generally to the shape of a rear portion of a trigger 64 (FIG. 7).

In FIG. 5, the central projecting portion also includes a pair of opposed guides 70, 72 for movably receiving the slide 54 (FIG. 6). Each guide defines a slot 74, 76, and corresponding tabs 78, 80 (FIG. 6 and in partial phantom in FIG. 7) on the slide 54. A trigger blocking projection 82 is positioned at an end of the base plate 53, and fits behind the trigger 64, and between the trigger and the frame 60, to prevent actuation of the trigger.

In operation, the slide 54 is moved back and forth to install, lock and remove the insert. With reference to FIG. 7, the slide 54 is positioned in the first, or installing/removing position to expose a trigger receiving recess 84 defined by the central projecting portion 62 and the trigger blocking projection 82. The insert 52 is placed in the trigger guard 58 so that the trigger 64 is received within the recess 84. The slide 54 covers the bore 66, so that the trigger cannot be improperly locked.

Once the trigger is positioned in the recess 84, the slide 54 is then moved to cover the trigger, as illustrated in FIG. 8. At the same time, the slide uncovers the lock-receiving bore 66, so that a lock shackle of a conventional lock (not shown) can be passed through the bore to secure the firearm. The gun is then locked, and the trigger is covered and cannot be actuated.

The present invention has a number of advantages over known devices. In the first embodiment, the present invention provides a trigger-engaging plug that blocks rearward movement and actuation of the trigger. In addition, the plug requires the user to pass a lock shackle behind the trigger, and thus the trigger cannot be actuated even if the trigger-engaging plug is removed from the trigger guard while locked. The present invention thus enhances the safety with which a firearm is stored. In the second embodiment, the present invention not only provides an insert used in combination with a lock, but the lock cannot be locked unless it is properly installed on the firearm.

In either embodiment, the present invention provides a measure of safety that is inexpensive and simple to operate, and is readily adaptable for use with either handguns or long guns. Each embodiment is fabricated of a molded plastic material. Therefore, the present devices can be manufactured at a significantly lower cost than the specially constructed locks discussed above.

Both embodiments fit within a firearm trigger guard, rather than around the guard as do "clamshell" type locks, to prevent the presence of gaps between the plug or insert and the trigger guard. Thus, the present invention provides a more secure locking than clamshell type devices, since there are no gaps around the trigger guard between which an implement can be inserted to actuate the trigger.

The present devices are each used with a separate lock. By separating the plug or insert from the lock, it is possible to use a lock of conventional construction, which further reduces the costs associated with locking a firearm, and further promotes the safe storage of firearms.

While preferred embodiments have been shown and described, various modifications and substitutions may be made without departing from the spirit and scope of the invention. For example, either embodiment may include one or more additional tabs opposite the respective base plate, which tabs positively engage a trigger guard and help snap an installed insert or plug in place. Accordingly, it is to be understood that the present invention has been described by way of example and not by limitation.

What is claimed is:

1. For a firearm having a trigger guard with an interior region contiguous with and extending from a firearm frame, and having a trigger extending from said firearm frame into said trigger guard region, the rear portion of the trigger being spaced from and in opposed relation with a portion of the firearm frame and moveable towards the firearm frame to actuate firearm, a monolithic trigger-engaging plug comprising:

a base portion having a recess for receiving the trigger, said base portion outer circumference to be substantially equal to said trigger guard interior region circumference; and a trigger-blocking projection extending from and positioned generally at one end of the base portion adjacent to the recess, the trigger-blocking projection defining a lock shackle-receiving bore; wherein when the plug is inserted in a trigger guard of a firearm, the trigger is received within the recess, the trigger-blocking projection is positioned behind the trigger to prevent the trigger from being moved toward the firearm frame and actuated, and the bore is positioned to receive a lock shackle between the rear of the trigger and firearm frame to prevent trigger movement;

a tang extending from and positioned on the base portion and in opposed relation with said trigger-blocking projection, the trigger-blocking projection and the tang defining the trigger-receiving recess;

a second projection extending from and positioned on the base portion, and in opposed relation with the tang, the second projection and the tang being positioned between the front of the trigger and the trigger guard when the plug is inserted within the trigger guard; wherein the second projection defines a recess and an opening along the base portion, and further comprising;

a cap extending from the tang and concealing the opening defined by the second projection.

* * * * *